US009857118B2

(12) United States Patent
Lee et al.

(10) Patent No.: US 9,857,118 B2
(45) Date of Patent: Jan. 2, 2018

(54) REFRIGERATOR

(71) Applicant: LG ELECTRONICS INC., Seoul (KR)

(72) Inventors: Seung Mok Lee, Gyeongsangnam-do (KR); Sang Ho Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/799,672

(22) Filed: Jul. 15, 2015

(65) Prior Publication Data

US 2015/0316307 A1 Nov. 5, 2015

Related U.S. Application Data

(63) Continuation of application No. 14/198,970, filed on Mar. 6, 2014, now Pat. No. 9,109,826, which is a (Continued)

(30) Foreign Application Priority Data

Dec. 22, 2009 (KR) ..... 10-2009-0129256
Dec. 22, 2009 (KR) ..... 10-2009-0129332
(Continued)

(51) Int. Cl.
*F25C 5/18* (2006.01)
*F25C 5/00* (2006.01)
(Continued)

(52) U.S. Cl.
CPC ..... *F25C 5/182* (2013.01); *F25C 5/005* (2013.01); *F25C 5/185* (2013.01); *F25C 5/046* (2013.01); *F25C 2400/08* (2013.01); *F25D 23/04* (2013.01)

(58) Field of Classification Search
CPC ..... F25C 5/005; F25C 5/182; F25C 5/185; F25C 5/046; F25C 2400/08; F25C 5/007;
(Continued)

(56) References Cited

U.S. PATENT DOCUMENTS 4,680,943 A 7/1987 Mawby et al.
6,082,130 A 7/2000 Pastryk
(Continued)

FOREIGN PATENT DOCUMENTS

EP 1491833 12/2004
EP 1517104 3/2005
(Continued)

OTHER PUBLICATIONS

Republic of China Office Action and Search Report dated Dec. 3, 2012, for Application No. 201010140606.7, with partial English Translation, 9 pages.
(Continued)

*Primary Examiner* — Mohammad M Ali
(74) *Attorney, Agent, or Firm* — Fish & Richardson P.C.

(57) ABSTRACT

A refrigerator is described that includes a slim refrigerator door. The refrigerator includes a storage compartment, a refrigerator door to open and close the storage compartment, and an ice maker to generate ice cubes. The refrigerator further includes an ice bin-at the refrigerator door to receive the ice cubes generated in the ice maker and having a discharge opening-for discharging the ice cubes. The refrigerator further includes a motor-at the refrigerator-and at least one blade-within the ice bin and connected to the-motor. The at least one ice cube directly drops onto the at least one blade. The at least one blade moves the at least one ice cube to the discharge and discharges the at least one ice cube from the ice bin by an operation of the motor.

10 Claims, 22 Drawing Sheets

Related U.S. Application Data continuation of application No. 12/730,445, filed on Mar. 24, 2010, now abandoned.

(30) Foreign Application Priority Data

Dec. 22, 2009 (KR) ..... 10-2009-0129333
Dec. 22, 2009 (KR) ..... 10-2009-0129334

(51) Int. Cl.
*F25C 5/04* (2006.01)
*F25D 23/04* (2006.01)

(58) Field of Classification Search
CPC ..... F25C 5/02; F25C 8/18; F25C 1/24; F25D 23/04; F25D 23/02; F25D 11/00; F25D 11/02; F25D 23/028; F25D 23/06; F25D 23/062; F25D 23/066
USPC ..... 62/344
See application file for complete search history.

(56) References Cited

U.S. PATENT DOCUMENTS

| | | | | |
|---|---|---|---|---|
| 7,386,992 | B2 | 6/2008 | Adamski et al. | |
| 7,422,168 | B2 | 9/2008 | Jung | |
| 7,437,885 | B2 | 10/2008 | Wu | |
| 7,797,961 | B2 | 9/2010 | An et al. | |
| 7,802,444 | B2 | 9/2010 | Landers | |
| 8,746,002 | B2 | 6/2014 | Lee | |
| 2004/0261442 | A1 | 12/2004 | Chung | |
| 2005/0061017 | A1 | 3/2005 | Lee | |
| 2006/0202071 | A1 | 9/2006 | Jung | |
| 2006/0213213 | A1 | 9/2006 | Chung et al. | |
| 2006/0248912 | A1* | 11/2006 | Park | F25C 5/005 62/344 |
| 2007/0074527 | A1 | 4/2007 | Lee et al. | |
| 2007/0193299 | A1 | 8/2007 | Landers | |
| 2008/0041089 | A1 | 2/2008 | Choi et al. | |
| 2008/0134709 | A1* | 6/2008 | Fischer | F25C 5/005 62/344 |
| 2008/0134710 | A1* | 6/2008 | An | F25C 5/007 62/344 |
| 2008/0156016 | A1 | 7/2008 | Jeong et al. | |
| 2008/0236187 | A1 | 10/2008 | Kim | |
| 2008/0295536 | A1* | 12/2008 | Kim | F25C 5/005 62/340 |
| 2008/0295538 | A1* | 12/2008 | Kim | F25C 5/007 62/354 |
| 2009/0019880 | A1 | 1/2009 | Lee et al. | |
| 2009/0133428 | A1* | 5/2009 | An | F25C 5/005 62/320 |
| 2009/0211292 | A1 | 8/2009 | Smith et al. | |
| 2010/0200610 | A1 | 8/2010 | Landers | |
| 2010/0313593 | A1 | 12/2010 | Lee | |
| 2010/0313595 | A1 | 12/2010 | Seo | |

FOREIGN PATENT DOCUMENTS

| | | |
|---|---|---|
| EP | 1701118 | 9/2006 |
| KR | 10-1998-0017938 | 6/1998 |
| KR | 10-2007-0103250 | 10/2007 |
| KR | 10-2008-0039617 | 5/2008 |
| WO | 2007/028029 | 3/2007 |
| WO | 2008/028741 | 3/2008 |
| WO | 2008//050991 | 5/2008 |
| WO | 2008/054161 | 5/2008 |
| WO | 2009/072794 | 6/2009 |
| WO | 2009/104864 | 8/2009 |

OTHER PUBLICATIONS

European Search Report dated Nov. 14, 2013 for Application EP10157228, 8 pages.
European Search Report dated Sep. 18, 2014, for Application No. 14173402.0-1605, 9 Pages.
European Office Action dated Oct. 9, 2014, for Application No. 10 157 228.7-1605, 8 Pages.
Office Action issued in Korean Application No. 10-2009-0129256 dated Nov. 19, 2015, 5 pages.

* cited by examiner

REFRIGERATOR

CROSS-REFERENCE TO RELATED APPLICATIONS

This application is a continuation of U.S. application Ser. No. 14/198,970, filed Mar. 6, 2014, which is a continuation of U.S. application Ser. No. 12/730,445, filed Mar. 24, 2010, which claims priority under 35 U.S.C. 119 and 35 U.S.C. 365 to Korean Patent Application Nos. 10-2009-0129256, 10-2009-0129332, 10-2009-0129333 and 10-2009-0129334 all filed on 22 Dec. 2009, all of which are hereby incorporated by reference in its entirety.

BACKGROUND

The present disclosure relates to a refrigerator.

Generally, a refrigerator is an apparatus that stores foods at a low temperature using low temperature air.

The refrigerator includes a cabinet in which a storage compartment is defined and a refrigerator door opening and closing the storage compartment. The storage compartment may include a refrigerator compartment and a freezer compartment. The refrigerator door may include a refrigerator compartment door opening and closing the refrigerator compartment and a freezer compartment door opening and closing the freezer compartment.

Also, the refrigerator may include an ice making assembly that makes ice using cool air to store the made ice. The ice making assembly includes an ice maker generating the ice and an ice bin in which the ice separated from the ice maker is stored. The ice maker may be disposed inside the refrigerator compartment or in the refrigerator compartment door. The ice bin may be disposed inside the refrigerator compartment or in the refrigerator compartment door. For user's convenience, the refrigerator compartment door may further include a dispenser for dispensing the ice stored in the ice bin.

SUMMARY

Embodiments provide a refrigerator.

In one embodiment, a refrigerator includes: a storage compartment; a refrigerator door configured to open and close the storage compartment; an ice maker configured to generate ice cubes; an ice bin provided at the refrigerator door, the ice bin being disposed below the ice maker to receive the ice cubes generated in the ice maker and having a discharge opening through which the ice cubes are discharged; a motor provided at the refrigerator door; and at least one blade disposed within the ice bin, the at least one blade being operably connected to the motor, wherein at least one ice generated in the ice maker directly drop onto the at least one blade, and the at least one blade moves at least one ice stored in the ice bin to the discharge opening to discharge the at least one ice from the ice bin by an operation of the motor.

In another embodiment, a refrigerator includes: a cabinet defining a storage compartment; and a refrigerator door configured to open and close the storage compartment, wherein the refrigerator door comprises: an ice compartment; an ice maker disposed within the ice compartment to generated ice cubes; an ice bin below the ice maker, the ice bin storing the ice cubes separated from the ice maker and having a discharge opening through which the ice cubes are discharged; and at least one rotation blade disposed within the ice bin, the at least one rotation blade moving the ice cubes in the bin toward the discharge opening, wherein at least one ice separated from the ice maker directly drop onto the at least one rotation blade.

In further embodiment, a refrigerator includes: a cabinet defining a storage compartment; and a refrigerator door configured to open and close the storage compartment, wherein the refrigerator door comprises: an ice compartment; an ice maker disposed within the ice compartment to generate ice cubes, the ice maker being configured to separate ice cubes by its rotation operation; an ice bin selectively received in the ice compartment, the ice bin being disposed below the ice maker to store the ice cubes separated from the ice maker and having a discharge opening through which the ice cubes are discharge; and at least one rotation blade above the discharge opening, the at least one rotation blade being rotatably operated, wherein the ice cubes separated from the ice maker by a rotation operation of the ice maker drop into the ice bin by their self-weight, at least one ice separated from the ice maker directly drops onto the at least one rotation blade, and the ice cubes stored in the ice bin are discharged downwardly from the ice bin through the discharge opening by the rotation of the at least one rotation blade.

In still further embodiment, a refrigerator includes: a cabinet defining a storage compartment; and a refrigerator door configured to open and close the storage compartment, wherein the refrigerator door comprises: an ice compartment; an ice maker disposed within the ice compartment to generate ice cubes; an ice bin configured to store the ice cubes separated from the ice maker, the ice bin having a discharge opening through which the ice cubes are discharged; and an ice compartment door configured to open and close the ice compartment, wherein, when the ice compartment door closes the ice compartment, the ice bin is disposed in a second region except a first region between the ice compartment door and the ice maker.

In even further embodiment, a refrigerator includes: a storage compartment; a refrigerator door configured to open and close the storage compartment; an ice maker configured to generate ice cubes; an ice bin provided at the refrigerator door, the ice bin being disposed below the ice maker to receive the ice cubes separated from the ice maker and having a discharge opening through which the ice cubes are discharged; a motor provided at the refrigerator door; at least one rotation blade disposed within the ice bin, the at least one blade being operably connected to the motor; and a rotation axis connected to the at least one rotation blade, wherein the ice cubes dropping into the ice bin are moved toward the least one rotation blade in a direction crossing an extending direction of the rotation axis, and the at least one rotation blade moves the ice cubes to the discharge opening to discharge the ice cubes from the ice bin by an operation of the motor.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
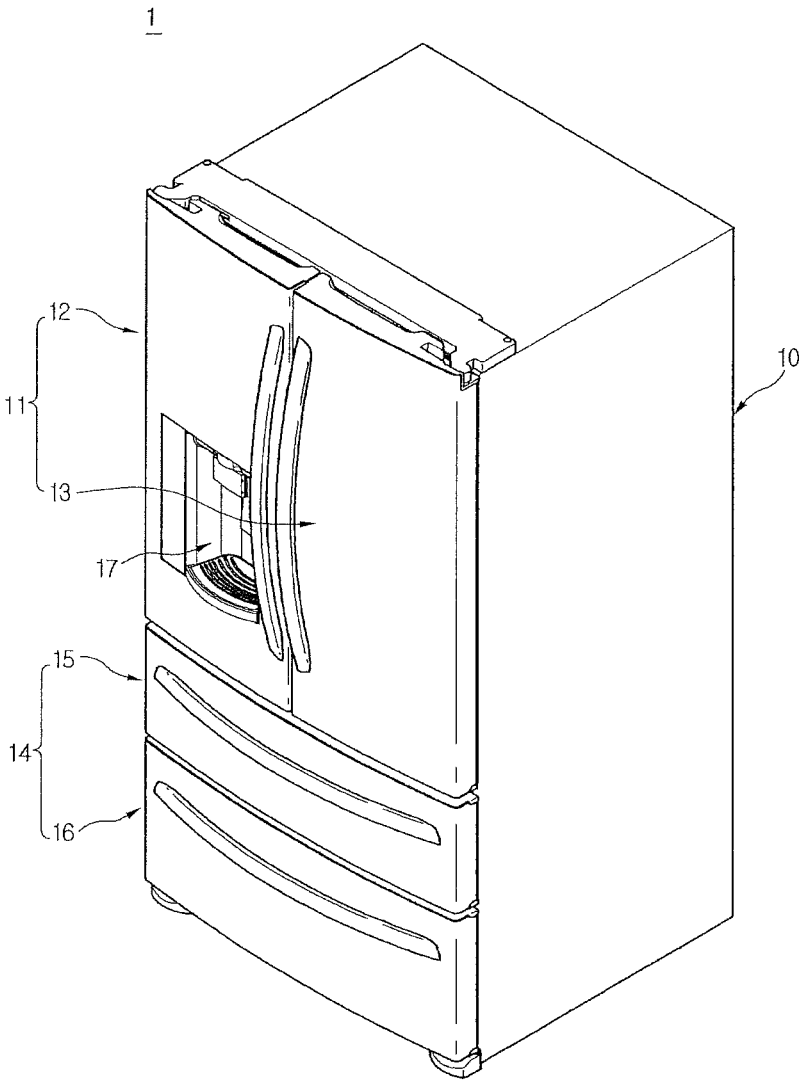
FIG. 1 is a perspective view of a refrigerator according to a first embodiment.
Figure 2:
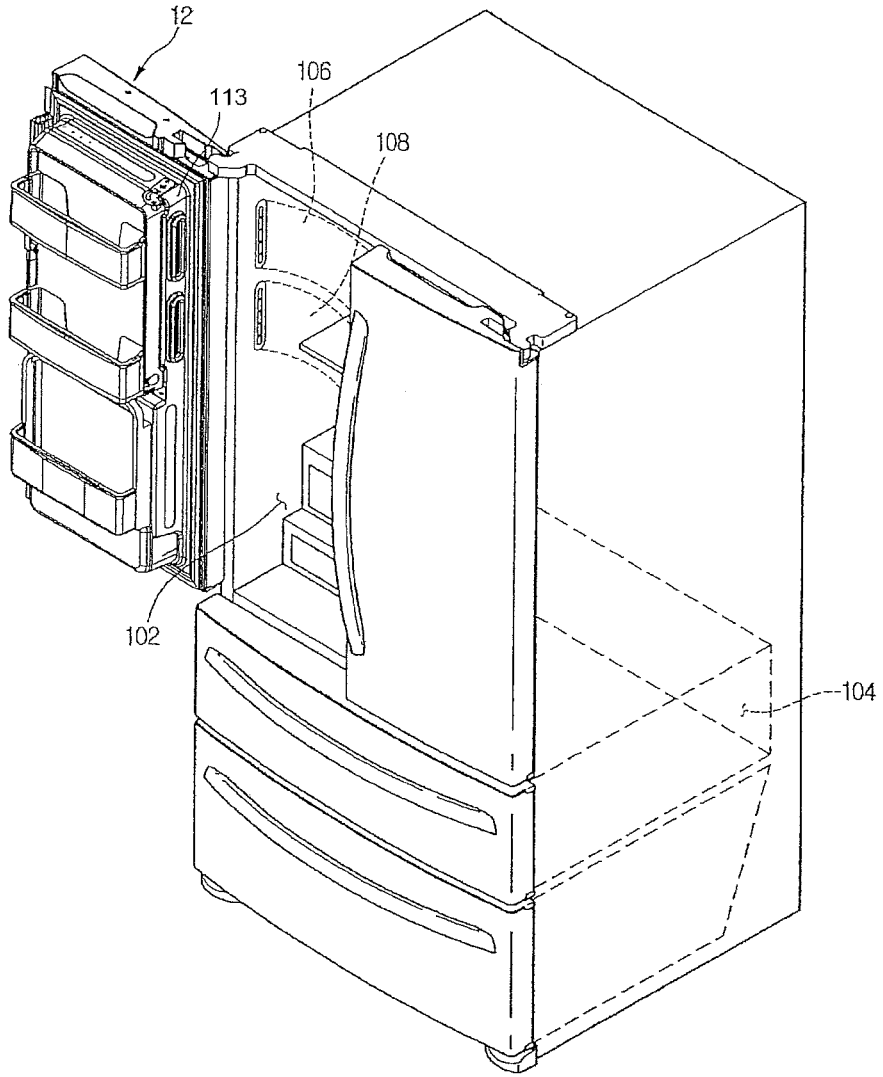
FIG. 2 is a perspective view of the refrigerator with a portion of a refrigerator compartment door opened according to the first embodiment.

FIG. 1 is a perspective view of a refrigerator according to a first embodiment. FIG. 2 is a perspective view of the refrigerator with a portion of a refrigerator compartment door opened according to the first embodiment.

Referring to FIGS. 1 and 2, a refrigerator 1 according to this embodiment includes a cabinet 10 defining an outer appearance thereof and refrigerator doors 11 and 14 movably connected to the cabinet 10.

A storage compartment for storing foods is defined inside the cabinet 10. The storage compartment includes a refrigerator compartment 102 and a freezer compartment 104 disposed below the refrigerator compartment 102.

That is, a bottom freeze type refrigerator in which a refrigerator compartment is disposed above the freezer compartment will be described as an example in this embodiment.

The refrigerator door 11 and 14 include a refrigerator compartment door 11 opening and closing the refrigerator compartment 102 and a freezer compartment door 14 opening and closing the freezer compartment 104.

The refrigerator compartment door 11 includes a plurality of doors 12 and 13, which are disposed at left and right sides, respectively. The plurality of doors 12 and 13 includes a first refrigerator compartment door 12 and a second refrigerator compartment door 13 disposed at a right side of the first refrigerator compartment door 12. The first refrigerator compartment door 12 may be independently movable with respect to the second refrigerator compartment door 13.

The freezer compartment door 14 includes a plurality of doors 15 and 16, which are vertically disposed. The plurality of doors 15 and 16 includes a first freezer compartment door 15 and a second freezer compartment door 16 disposed below the first freezer compartment door 15. The first and second refrigerator compartment doors 12 and 13 may be rotatably moved, and the first and second freezer compartment doors 15 and 16 may be slidably moved.

Alternatively, one freezer compartment door 14 may be provided to open and close the freezer compartment 104.

A dispenser 17 for dispensing water or ice is disposed in one door of the first and second refrigerator compartment door 12 and 13. For example, the dispenser 17 is disposed in the first refrigerator door 12 in FIG. 1. Also, an ice making assembly (that will be described later) for generating and storing the ice cubes is disposed in one door of the first and second refrigerator compartment doors 12 and 13.

In this embodiment, the dispenser 17 and the ice making assembly may be disposed in the first refrigerator compartment door 12 and the second refrigerator compartment door 13. Thus, it will be described below that the dispenser 17 and the ice making assembly are disposed in the refrigerator compartment door 11. Here, the first refrigerator compartment door 12 and the second refrigerator compartment door 13 are commonly called the refrigerator compartment door 11.

Figure 3:
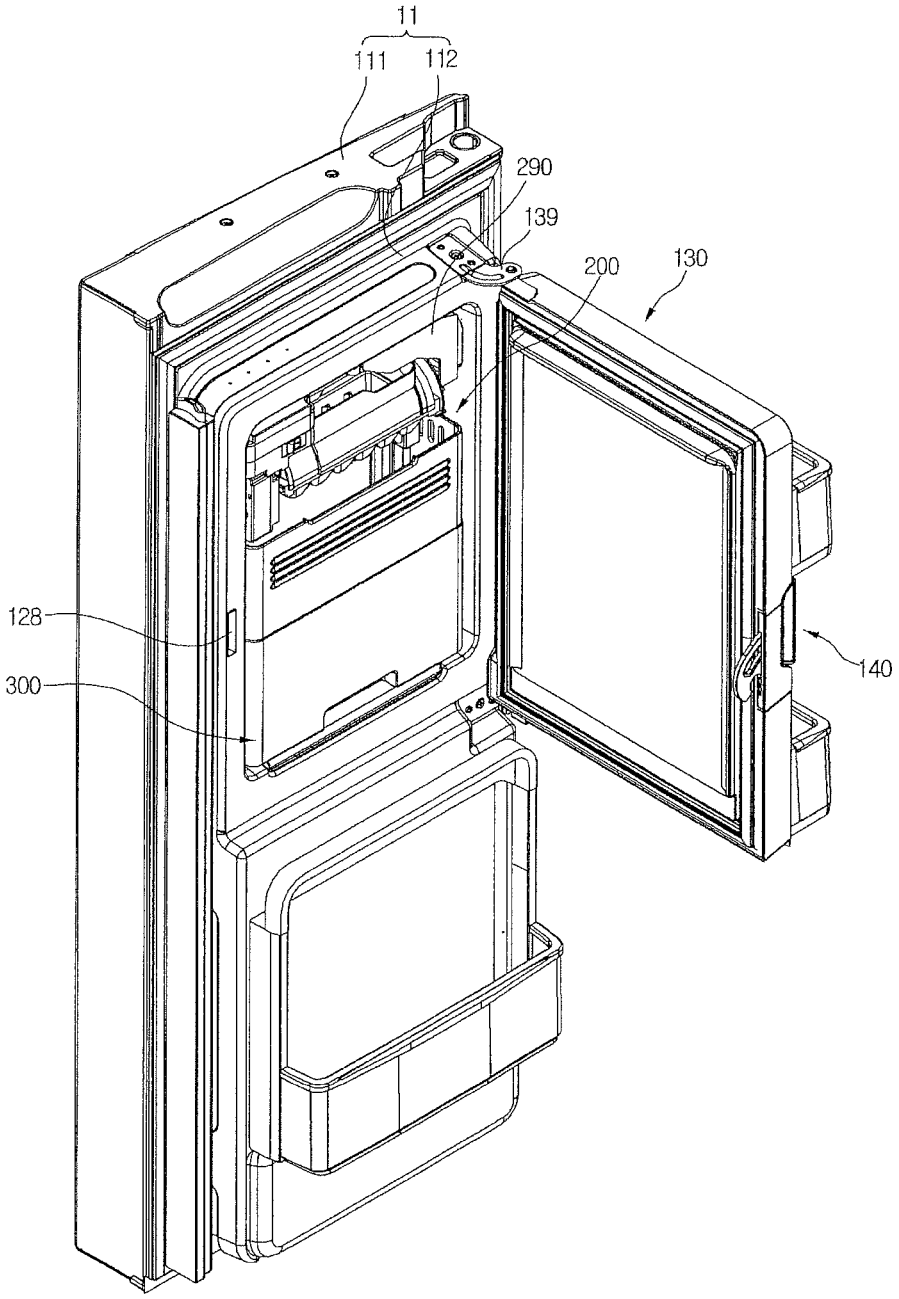
FIG. 3 is a perspective view of the refrigerator compartment door with an ice compartment door opened according to the first embodiment.
Figure 4:
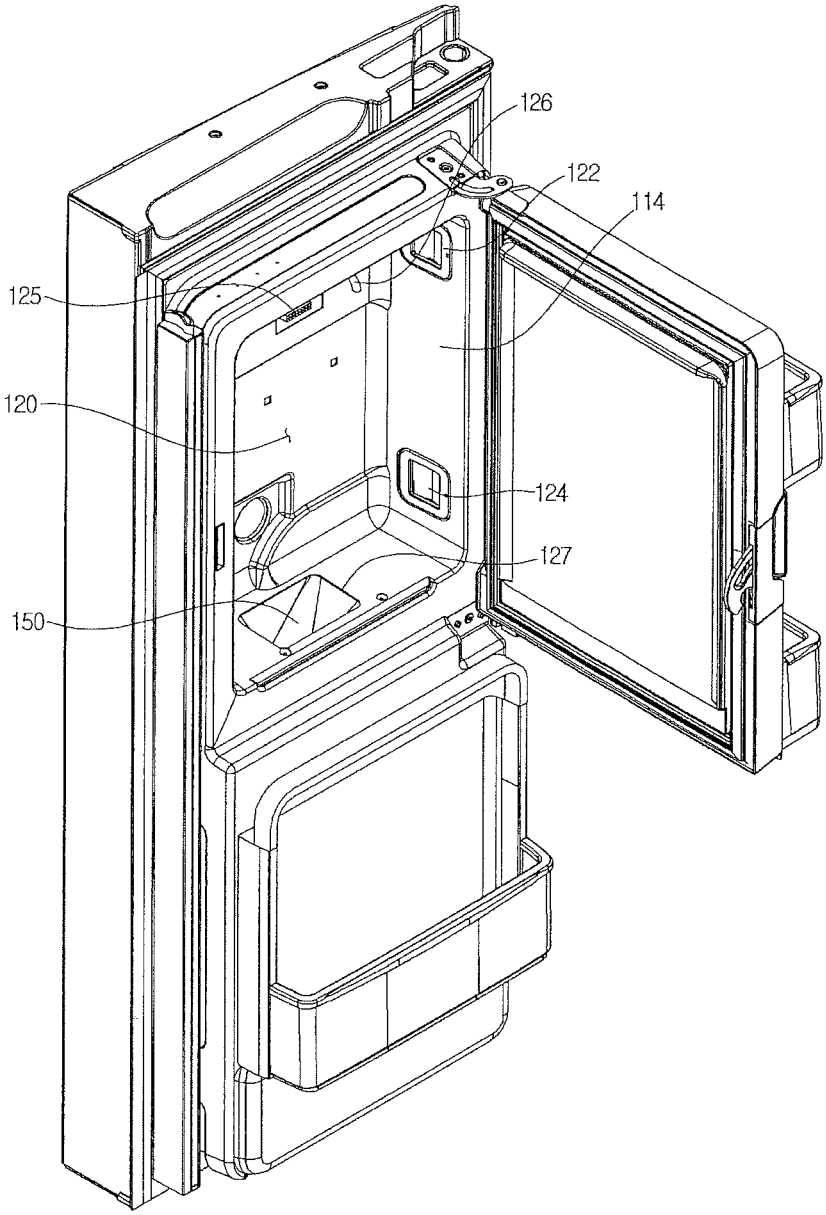
FIG. 4 is a perspective view of a refrigerator compartment door in which an ice making assembly is removed from an ice compartment according to the first embodiment.

FIG. 3 is a perspective view of the refrigerator compartment door with an ice compartment door opened according to the first embodiment. FIG. 4 is a perspective view of a refrigerator compartment door in which an ice making assembly is removed from an ice compartment according to the first embodiment.

Referring to FIGS. 1 to 4, the refrigerator compartment door 11 includes an outer case 111 and a door liner 112 coupled to the outer case 111. The door liner 112 defines a back surface of the refrigerator compartment door 11.

The door liner 112 defines an ice compartment 120. The ice making assembly 200 for generating and storing the ice cubes is disposed inside the ice compartment. The ice compartment 120 is opened and closed by an ice compartment door 130. The ice compartment door 130 is rotatably connected to the door liner 112 by a hinge 139. A handle 140 coupled to the door liner 112 in a state where the ice compartment 120 is closed by the ice compartment door 130 is disposed on the ice compartment door 130.

A handle coupling part 128 coupled to a portion of the handle 140 is defined in the door liner 112. The handle coupling part 128 receives the portion of the handle 140.

The cabinet 10 includes a main body supply duct for supplying cool air to the ice compartment 120 and a main body return duct 108 for recovering the cool air from the ice compartment 120. The main body supply duct 106 and the main body return duct 108 may communicate with a space in which an evaporator (not shown) is disposed.

The refrigerator compartment door 11 includes a door supply duct 122 for supplying the cool air of the main body supply duct 106 to the ice compartment and a door return duct 124 for recovering the cool air of the ice compartment 120 to the main body return duct 108.

The door supply duct 122 and the door return duct 124 extend from an outer wall 113 of the door liner 112 to an inner wall 114 constituting the ice compartment 120. The door supply duct 122 and the door return duct 124 are vertically arrayed, and the door supply duct 122 is disposed over the door return duct 124. However, in this embodiment, the positions of the door supply duct 122 and the door return duct 124 are not limited thereto.

When the refrigerator compartment door 11 closes the refrigerator compartment 102, the door supply duct 122 is aligned and communicates with the main body supply duct 106, and the door return duct 124 is aligned and communicates with the main body return duct 108.

The ice compartment 120 includes a cool air duct 290 guiding cool air flowing in the door supply duct 122 to the ice making assembly 200. The cool air duct 290 includes a passage through which cool air flows, and cool air flowing in the cool air duct 290 is finally supplied to the ice making assembly 200. Since cool air may be concentrated to the ice making assembly 200 through the cool air duct 290, ice cubes may be rapidly generated.

The refrigerator compartment door 11 includes a first connector 125 for supplying an electric source to the ice making assembly 200. The first connector 125 is exposed to the ice compartment 120. The refrigerator compartment door 11 includes a water supply pipe 126 for supplying water to the ice making assembly 200.

The water supply pipe 126 is disposed between the outer case 111 and the door liner 112, and its end passes through the door liner 112 and is disposed at the ice compartment 120.

An ice opening 127 for discharging ice cubes is disposed at the lower side of the inner wall 114 of the door liner 112 constituting the ice compartment 120. An ice duct 150 communicating with the ice opening 127 is disposed at the lower side of the ice compartment 120.

Hereinafter, a structure of the ice making assembly will be described in detail.

Figure 5:
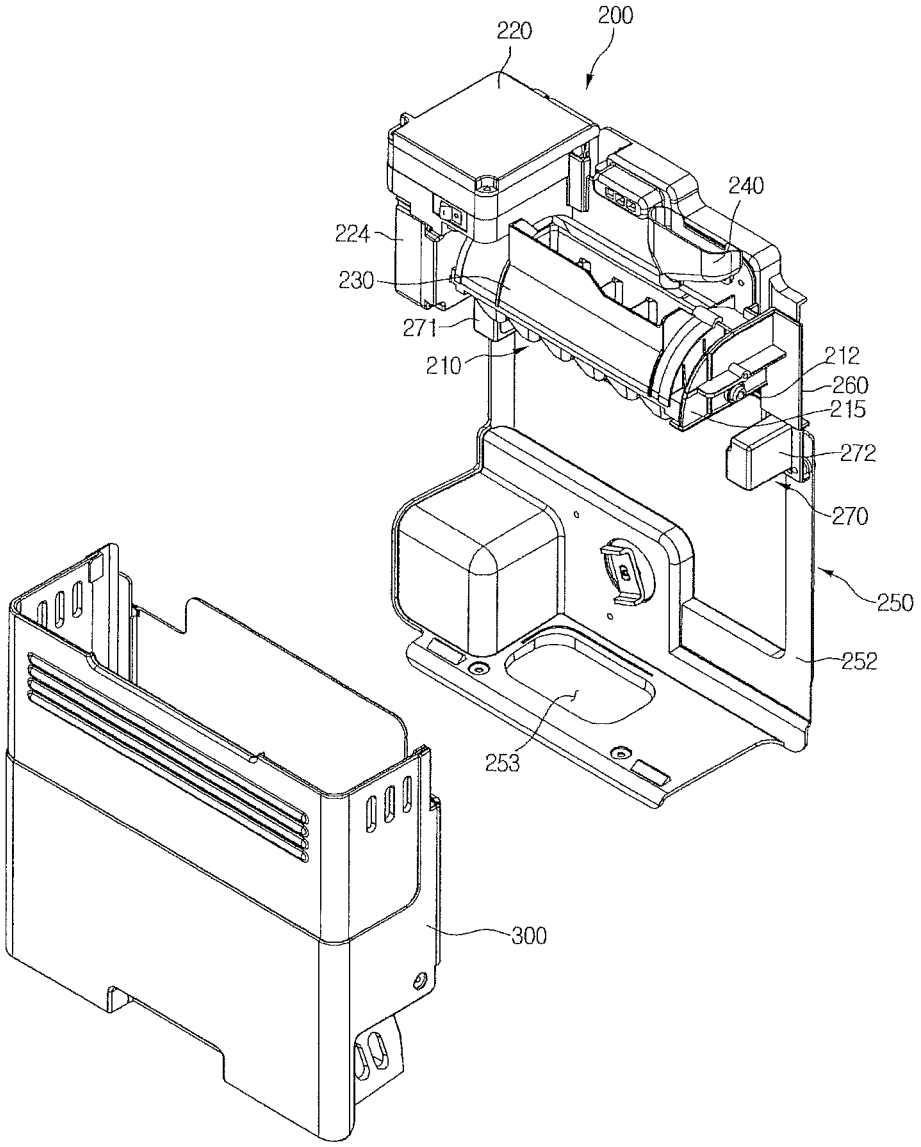
FIGS. 5 and 6 are perspective views of the ice making assembly according to the first embodiment.
Figure 6:
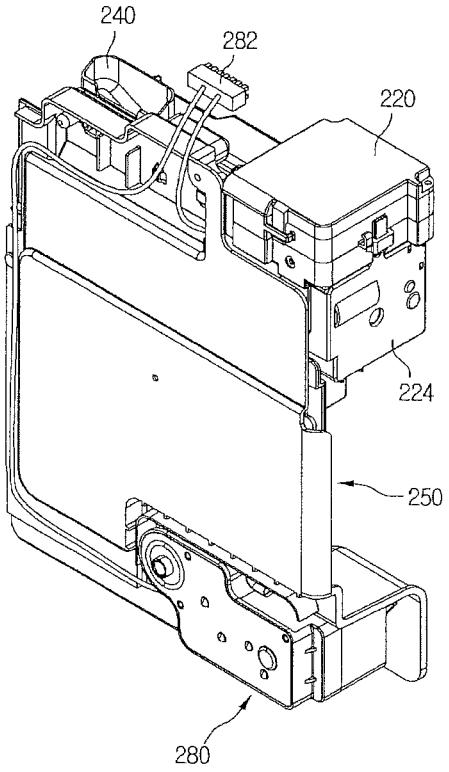

FIGS. 5 and 6 are perspective views of the ice making assembly according to the first embodiment.

Referring to FIGS. 3 to 6, the ice making assembly 200 defines spaces where ice cubes are generated, and includes an ice maker 210 supporting generated ice, a driving source 220 providing power for automatically rotating the ice maker 210 to remove ice cubes from the ice maker 210, a gear box 224 transmitting the power of the driving source 220 to the ice maker 210, a cover 230 covering the ice maker 210 to prevent the overflow of water when the water is supplied to the ice maker 210, and a water guider 240 guiding water supplied from the water supply pipe 126 to the ice maker 210.

The ice making assembly 200 includes a support mechanism 250 including a seat part 215 on which the ice maker 210 is placed, an ice bin 300 storing ice cubes removed from the ice maker 210, a full ice sensor 270 for sensing full ice state of the ice bin 300, and a motor assembly 280 selectively connected to the ice bin 300.

An electric wire connected to the motor assembly 280 and an electric wire connected to the driving source 220 are connected to a second connector 282 that is removably coupled to the first connector 125.

In detail, the driving source 220 may include a motor.

The support mechanism 250 includes a first support part 252 and a second support part 260 coupled to the first support part 252.

The first support part 252 is placed on the ice compartment 120. The motor assembly 280 is installed on the first support part 252. An ice opening 253 through which ice cubes discharged from the ice bin 300 pass is disposed in the bottom surface of the first support part 252. The ice bin 300 is placed on the first support part 252. That is, the first support part 252 supports the ice bin 300.

When the ice bin 300 is placed on the first support part 252, the motor assembly 280 is connected to the ice bin 300. In this embodiment, the state where the ice bin 300 is placed on the first support part 252 means the state where the ice compartment 120 accommodates the ice bin 300.

The seat part 215 on which the ice maker 210 is placed is installed on the second support part 260. The ice maker 210 includes a rotation shaft 212 at a side. The rotation shaft 212 is rotatably coupled to the seat part 215. An extension part (not shown) extending from the gear box 224 is connected to another side of the ice maker 210.

The full ice sensor 270 is installed on the second support part 260 at a position spaced apart from the ice maker 210. The full ice sensor 270 is disposed under the ice maker 210.

The full ice sensor 270 includes a transmission part 271 transmitting a signal, and a receiving part 272 spaced apart from the transmission part 271 and receiving a signal from the transmission part 271. The transmission part 271 and the receiving part 272 are disposed in the inner space of the ice bin 300 when the ice bin 300 is placed on the first support part 252.

Hereinafter, the ice bin 300 will be described in detail.

Figure 7:
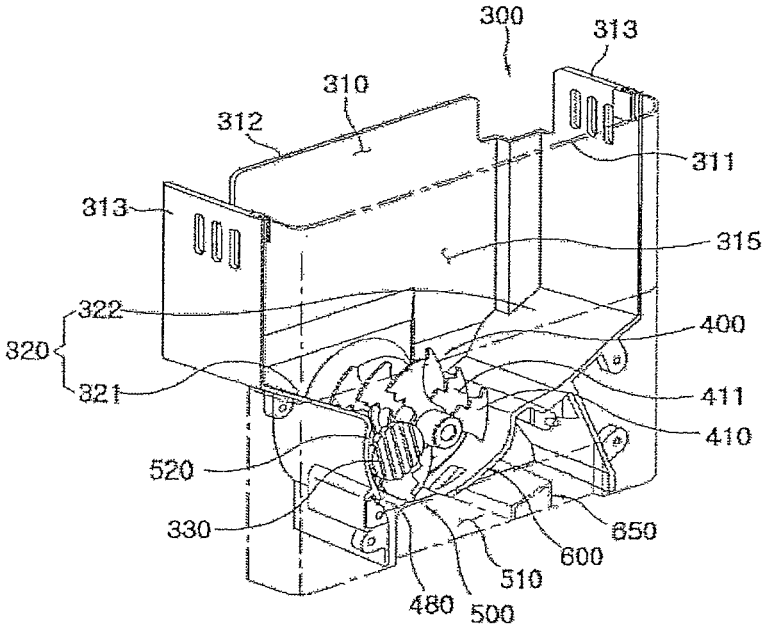
FIG. 7 is a perspective view of an ice bin according to the first embodiment.

FIG. 7 is a perspective view of an ice bin according to the first embodiment.

Referring to FIG. 7, an opening 310 is defined at an upper side of the ice bin 300. The ice bin 300 has a front wall 311, a rear wall 312, and sidewalls 313.

An inclined guide surface is disposed inside the ice bin 300 to support the stored ice cubes and guide the stored ice cubes such that the ice cubes slide downwardly by their self-weight.

An ice storage space 315 in which the ice cubes are stored is defined by the front wall 311, the rear wall 312, the sidewalls 313, and the inclined guide surface 320.

The inclined guide surface 320 includes a first inclined guide surface 321 and a second inclined guide surface 322. The first inclined guide surface 321 is inclined downwardly from one wall of the sidewalls 313 toward a central portion. The second inclined guide surface 322 is inclined downwardly from the other wall of the sidewalls 313 toward the central portion.

An ice discharge member 400 is disposed between the first inclined guide surface 321 and the second inclined guide surface 322 to discharge the ice cubes received in the ice bin 300 to the outside of the ice bin 300. That is, the first inclined guide surface 321 and the second inclined guide surface 322 are disposed at left and right sides of the ice discharge member 400.

The ice discharge member 400 includes one or more rotation blades 410 to define a predetermined space 411 in which the ice cubes is disposed. The ice discharge member 400 may include a plurality of rotation blades 410 to easily discharge the ice cubes.

Hereinafter, the ice discharge member 400 including the plurality of rotation blades 410 will be described as an example.

The ice cubes disposed on the first inclined guide surface 321 and the second inclined guide surface 322 are moved toward the ice discharge member 40 by their self-weight. Then, the ice cubes are discharged to the outside by an operation of the ice discharge member 400.

The ice discharge member 400 is rotatably disposed between the first inclined guide surface 321 and the second inclined guide surface 322. In addition, a discharge part 500 having a discharge opening 510 in which the ice cubes are finally discharged is disposed between the first inclined guide surface 321 and the second inclined guide surface 322.

The ice discharge member 400 is forwardly/reversely and rotatably (or rotatable in both directions) disposed on the discharge part 500.

When the ice discharge member 400 is rotated in a first direction, one or more fixed blades 480 interacting with the rotation blades 410 to crash the ice cubes are disposed at a side of a lower portion of the ice discharge member 400, i.e., a side of the discharge part 500.

To easily crash the ice cubes, a plurality of fixed blades 480 may be disposed in ice bin 300. Hereinafter, the ice bin 300 including the plurality of fixed blades 480 will be described as an example.

The plurality of fixed blades 480 is spaced from each other, and the rotation blades 410 pass through a space between the plurality of fixed blades 480.

When the ice is compressed by the rotation operations of the rotation blades 410 in a state where the ice jammed between the fixed blades 480 and the rotation blades 410, the ice is crashed to form ice chips.

When the ice discharge member 400 is rotated in a second direction opposite to the first direction, an opening/closing member 600 selectively communicating with the discharge opening 510 and the ice storage space 315 to discharge ice cubes is disposed at the side of the lower portion of the ice discharge member 400, i.e., the side of the discharge part 500.

An operation restriction part 650 is disposed below the opening/closing member 600 to restrict an operation range of the opening/closing member 600, thereby preventing the ice cubes from being excessively discharged.

The discharge part 500 has a discharge guide wall 520 having a configuration corresponding to a rotational track of the rotation blade 410. The fixed blades 480 are disposed below the discharge guide wall 520.

The discharge guide wall 520 prevents the crushed ice chips from remaining on the discharge part 500. An ice jam prevention part 330 protruding toward the rotation blade 410 is disposed on a back surface 312 of the front wall 311 of the ice bin 300 to prevent the ice cubes from being jammed between the rotation blades 410 and the front wall 311 of the ice bin 300.

Figure 8:
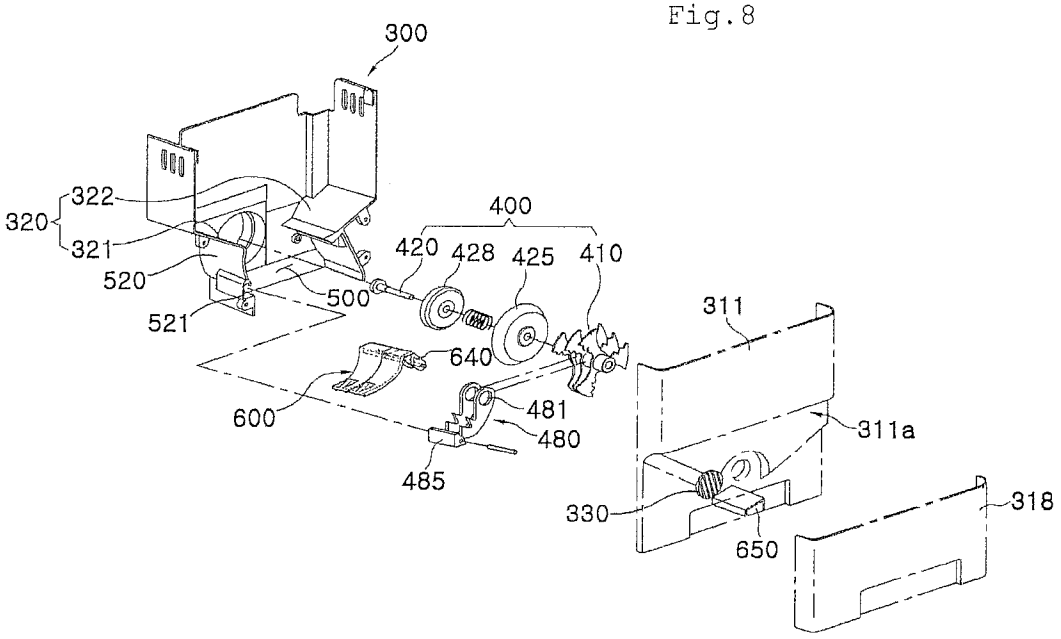
FIG. 8 is an exploded perspective view of the ice bin.

FIG. 8 is an exploded perspective view of the ice bin.

Referring to FIGS. 7 and 8, the plurality of rotation blades 410 is fixed to a rotation axis 420. The rotation axis 420 passes through a connection plate 428 connected to a support plate 425 and the motor assembly (see reference numeral 280 of FIG. 6). The rotation axis 420 is horizontally disposed within the ice bin 300.

The plurality of rotation blades 410 is disposed spaced from each other in a direction parallel to an extending direction of the rotation axis 420.

The rotation axis 420 is connected to one side of each of the plurality of fixed blades 480. That is, the rotation axis 420 passes through the plurality of fixed blades 480. A through-hole 481 through which the rotation axis 420 passes is defined in the respective fixed blades 480.

Here, the through-hole 481 may have a diameter greater than that of the rotation axis 420 such that the fixed blades 480 are not moved when the rotation axis 420 is rotated.

The plurality of rotation blades 410 and the plurality of fixed blades 480 may be alternately disposed in the direction parallel to the extending direction of the rotation axis 420.

As described above, the other side of each of the plurality of fixed blades 480 is fixed to a lower side of the discharge guide wall 520. A fixing member 485 is connected to the other side of the respective fixed blades 480 and inserted into a groove 521 defined in the discharge guide wall 520.

The opening/closing member 600 may be provided in one or plurality. The opening/closing member 600 is disposed at a lateral side of the plurality of fixed blades 480.

The opening/closing member 600 is rotatably disposed on the discharge part 500. The opening/closing member 600 may be formed of an elastic material or supported by an elastic member 640 such as a spring.

This is done for returning the opening/closing member 600 to its initial position when a compression effect is released in a state where an end of the opening/closing member 600 is moved downwardly by the compression effect due to the ice cubes.

The ice discharge member 400, the fixed blade 480, and the opening/closing member 600 are disposed within the ice bin 300, and then, a front plate 311*a* constituting the front wall 311 of the ice bin 300 is disposed.

A cover member 318 may be disposed at a lower portion of a front surface of the front plate 311*a* to prevent the opening/closing member 600 or the fixed blade 480 from being exposed to the outside.

Figure 9:
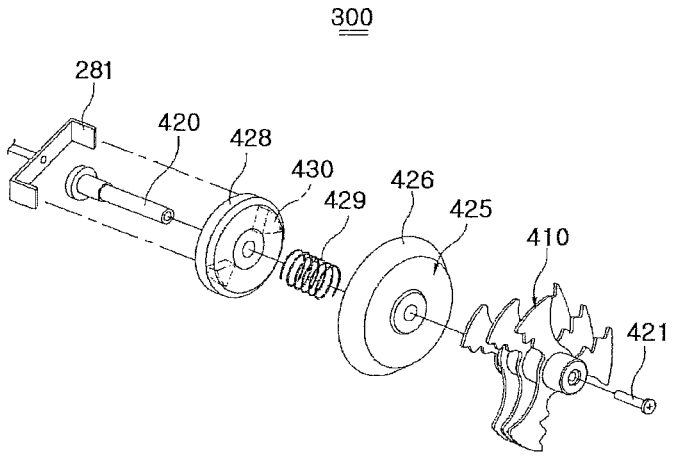
FIG. 9 is an exploded perspective view of an ice discharge member.

FIG. 9 is an exploded perspective view of an ice discharge member.

Referring to FIGS. 7 to 9, an elastic member 429 having a coil shape is disposed between the support plate 425 and the connection plate 428 to elastically support the connection plate 428.

In a state where the rotation blade 410, the support plate 425, the connection plate 428, and the elastic member 429 are coupled to the rotation axis 420, an insertion member 421 is inserted into a front end of the rotation axis 420.

The motor assembly (see reference numeral 280 of FIG. 6) includes a connection member 281 selectively connected to the connection plate 428. A protrusion 330 on which the connection member 281 is hooked is disposed on the connection plate 428.

When the protrusion 430 and both ends of the connection member 281 are aligned with each other in a state where a user receives the ice bin 300 into the ice compartment 120, the connection member 281 is not hooked on the protrusion 430. In this case, the guide plate 428 is moved toward the support plate 425 by the elastic member 429.

Thereafter, when the alignment between both ends of the connection member 281 and the protrusion 430 is released by a continuous operation of the motor assembly (see reference numeral 280 of FIG. 6), the connection plate 428 is moved backwardly by the elastic member 429, and thus, both ends of the connection member 281 is hooked on the protrusion 430.

The support plate 425 has an inclined surface 426 to smoothly move the ice cubes disposed on a lateral surface of the support plate 425 toward the plurality of rotation blades 410.

Figure 10:
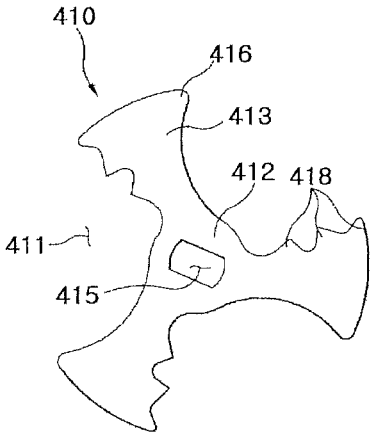
FIG. 10 is a front view of a rotation blade of the ice bin.

FIG. 10 is a front view of a rotation blade of the ice bin.

Referring to FIG. 10, the respective rotation blades 410 include a central portion 412 through which the rotation axis 420 passes and extension parts 413 radially extending from the central portion 412.

A through-hole 415 through which the rotation axis 420 passes is defined in the central portion 412. The through-hole may have a non-circular shape or a long hole shape to smoothly transmit a rotation force of the rotation axis 420 to the central portion 412.

The plurality of extension parts 413 may be spaced from each other. A space 411 in which the ice cubes are disposed is defined between the two extension parts 413 adjacent to each other.

The respective extension parts 413 have a width gradually increasing from the central portion 412 toward the outside. A hook part 416 is disposed on an end of the extension part 413 to prevent the ice cubes disposed in the space 411 from overflowing.

Thus, when the rotation blade 410 is rotated in a state where the ice cubes are received into the space 411, the ice cubes disposed at the end of the extension part 413 is hooked and moved together with the rotation blade 410 in a rotation direction of the rotation blade 410.

A crash part having a saw-tooth shape is disposed at one side of the extension part 413 to crash the ice by interacting with the fixed blade 480.

A smooth surface is disposed at the other side of the extension part 413 to move the ice cubes to a side opposite to the crash part 418 while the ice cubes are maintained in the ice cube state. Thus, the crash part 418 of one extension part 418 is disposed at a side opposite to the smooth surface of the other extension part 418 in one space 411.

Figure 11:
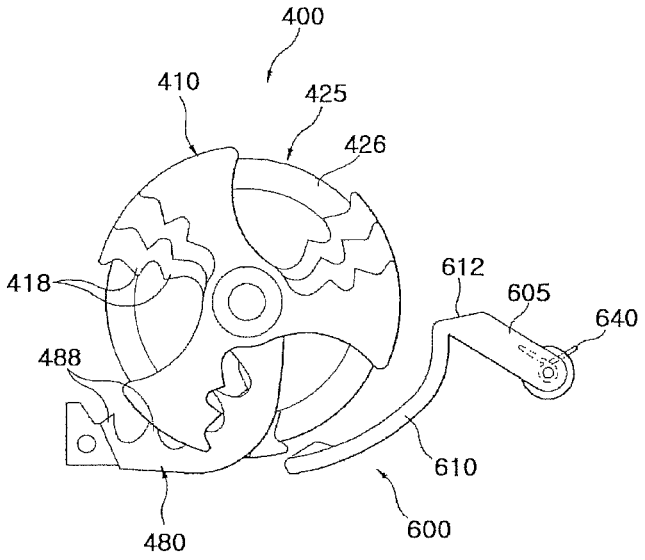
FIG. 11 is a front view of the ice discharge member, a fixed blade, and an opening/closing member of the ice bin.

FIG. 11 is a front view of the ice discharge member, a fixed blade, and an opening/closing member of the ice bin.

Referring to FIG. 11, when the rotation blade 410 is connected to the rotation axis 420, the plurality of rotation blades 410 does not completely overlap, but is disposed in a slightly twisted state from a front side toward a rear side.

That is, when viewed from a front side, the plurality of rotation blades 410 does not completely overlap each other, but is disposed in a state in which the behind rotation blade 410 is rotated by a predetermined angle.

In case where the plurality of rotation blades 410 is disposed in completely overlapping relationship in front and rear directions, when the plurality of rotation blades 410 for crushing the ice cubes is rotated in the first direction, a pressure applied to the ice cubes is dispersed. As a result, it is difficult to crush the ice cubes.

However, as described above, in case where the plurality of rotation blades is sequentially disposed in a state where they are rotated at a predetermined angle, the ice cubes contact the crush part 418 of the first rotation blade 410 and thus are crushed. Thereafter, the crushed ice cubes sequentially contract the crush part 418 of the second rotation blade 410, and then the crush part 418 of the third rotation blade 410 with a predetermined time interval.

Thus, the rotation force of the ice discharge member 400 may be concentrated into the respective crush parts 418 to significantly improve the ice crush efficiency.

Also, the crush part 488 having the saw-tooth shape may be disposed on the fixed blade 480 to crush the ice cubes.

The opening/closing member 600 is disposed in a lateral direction of the fixed blade 480. The opening/closing member 600 includes a rotation part 605 rotatably disposed within the ice bin 300. The rotation part 605 is elastically supported by the elastic member 640 having a torsion spring shape. The elastic member 640 has one end fixed to the ice bin 300 and the other end seated on a surface of the opening/closing member 600 to elastically support the opening/closing member 600.

The opening/closing member 600 has a rounded first guide surface 610 and a second guide surface 612 connected to the rotation part 605. At this time, the second guide surface 612 and the second inclined guide surface (see reference numeral 322 of FIG. 7) constitutes a continuous surface.

Figure 12:
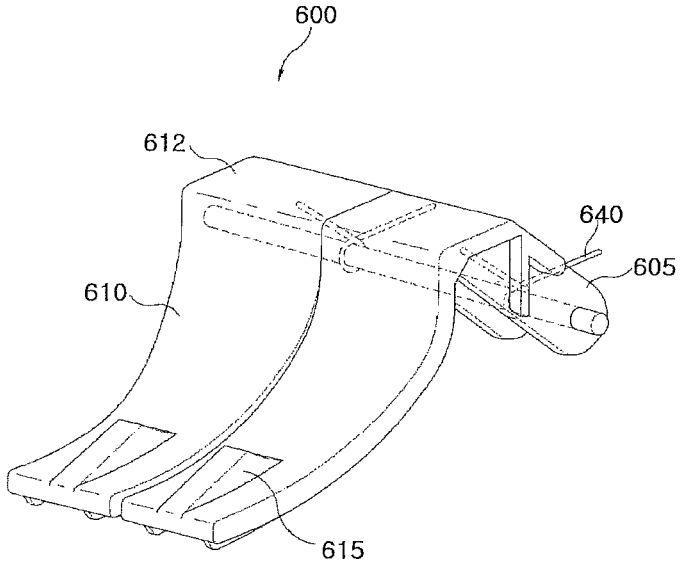
FIG. 12 is a perspective view of the opening/closing member of FIG. 11.

FIG. 12 is a perspective view of the opening/closing member of FIG. 11.

Referring to FIGS. 6 and 12, the opening/closing member 600 may be provided in plurality. The plurality of opening/closing members 600 is independently moved with respect to each other.

If a single opening/closing member 600 is disposed within the ice bin 300, other ice cubes may be discharged through a gap at which the ice is not disposed when the ice cubes are not discharged but stay on only a portion of the first guide surface 610 of the opening/closing member 600.

However, if a plurality of opening/closing member 600 is disposed within the ice bin 300, even through the ice cubes are hooked on one opening/closing member 600 to maintain the opening/closing member 600 in an open state, the other opening/closing member 600 on which the ice cubes are not hooked may maintain a close state to prevent the ice cubes from being unnecessarily discharged.

At this time, the elastic member 640 may be disposed on each of the plurality of opening/closing members 600. The respective opening/closing members 600 include a hook jaw 615 to prevent the ice cubes jammed between the opening/closing members 600 and the plurality of rotation blades 410 from being discharged to the outside when each of the opening/closing members 600 is in the close state.

The hook jaw 615 may be disposed on an end of a top surface of the first guide surface 610.

Figure 13:
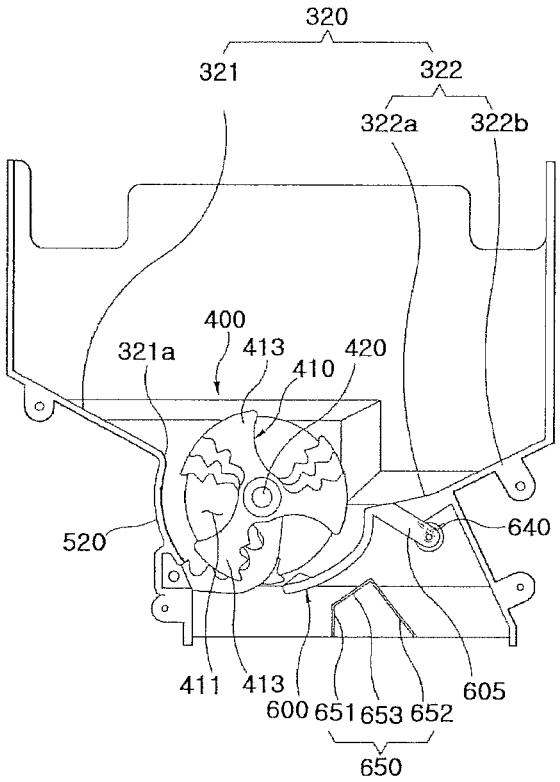
FIG. 13 is a front view illustrating the inside of the ice bin.
Figure 14:
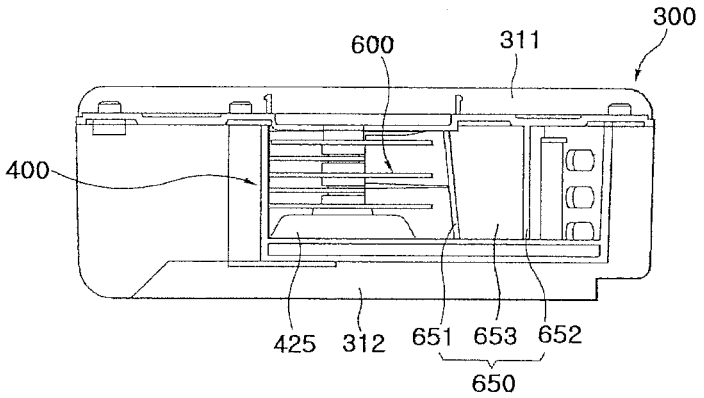
FIG. 14 is a bottom view of the ice bin.

FIG. 13 is a front view illustrating the inside of the ice bin, and FIG. 14 is a bottom view of the ice bin.

Referring to FIGS. 6 to 14, the first inclined guide surface 321 is disposed adjacent to the plurality of fixed blades 480. The second inclined guide surface 322 is disposed adjacent to the opening/closing member 600.

A discharge guide wall 520 connected to the first inclined guide surface 321 is disposed at a side of the discharge part 500. The second inclined guide surface is divided into two sections. This is done for adjusting a movement speed of the ice cubes moved along the second inclined guide surface 322 toward the ice discharge member 400 to prevent the ice cubes from being broken out.

The second inclined guide surface 322 includes an outwardly inclined guide surface **322*b* connected to the sidewalls 313 of the ice bin 300 and an inwardly inclined guide surface 322*a* connected to the outwardly inclined guide surface 322*b* and disposed adjacent to the ice discharge member 400**.

The inwardly inclined guide surface **322*a* is inclined at an angle less than that of the outwardly inclined guide surface 322*b*. Thus, the ice cubes downwardly moved along the outwardly inclined guide surface 322*b* are reduced in speed at the inwardly inclined guide surface 322*a*. The second guide surface 612 of the opening/closing member 600 is disposed at an end of the inwardly inclined guide surface 322*a* to constitute a continuous surface together with the inwardly inclined guide surface 322*a***.

When the opening/closing member 600 closes the discharge opening 510, the second guide surface 612 and the inwardly inclined guide surface **322*a*** form the continuous surface to reduce the movement speed of the ice cubes.

When the opening/closing member 600 opens the discharge opening 510, the second guide surface 612 is downwardly moved to guide the ice cubes toward the discharge opening 510. An inclination end point **321*a* of the first inclined guide surface 321 is disposed at a position higher than that of the rotation axis 420 of the ice discharge member 400. This is done for preventing fragments of the ice cubes crushed at a position at which the fixed blade 480** is disposed from being upwardly moved again.

To prevent the fragments of the crushed ice cubes from staying, the discharge guide wall 520 may have a curvature corresponding to that of the rotational track of the rotation blade 410.

Also, to maintain the ice cubes in the ice cube state, the second inclined guide surface 322 may be inclined at an angle less than that of the first inclined guide surface 321.

The inwardly inclined guide surface 322*a* of the second inclined guide surface 322 may be inclined at the substantially same angle as that of the second guide surface 612 of the opening/closing member 600 to form a continuous surface.

The rotation part 605 of the opening/closing member 600 is disposed at a position lower than that of the rotation axis 420 of the ice discharge member 400 such that the second inclined guide surface 322 is inclined at an angle less than that of the first inclined guide surface 321.

The operation restriction part 650 for restricting an opening angle of the opening/closing member 600 is disposed below the opening/closing member 600.

The operation restriction part 650 includes a vertically disposed first rib 651, a second rib 652 spaced from the first rib 651 and having a height greater than that of the first rib 651, and an inclined contact part 653 connecting an upper portion of the first rib 651 to an upper portion of the second rib 652.

The opening/closing member 600 is stopped by contacting the contact part 653.

As described above, the opening/closing member 600 may be provided in plurality. Also, the opening/closing members 600 may have maximum opening angles different from each other, respectively.

Figure 15:
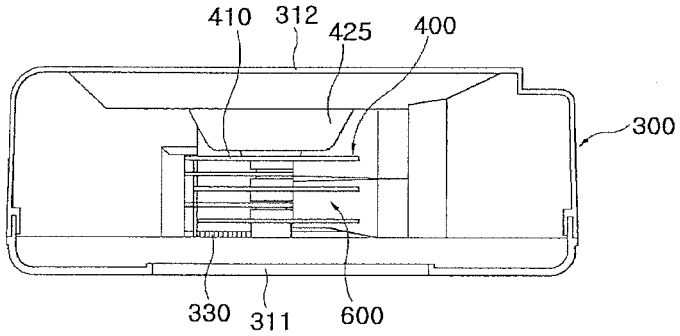
FIG. 15 is a plan view of the ice bin.

FIG. 15 is a plan view of the ice bin.

Referring to FIG. 15, the ice jam prevention part 330 is disposed inside the front wall 311 of the ice bin 300. The ice jam prevention part 330 protrudes or extends inwardly from the front wall 311 of the ice bin 300.

The ice jam prevention part 330 disposed in a space between the rotation blade 410 disposed at the most front side of the plurality of rotation blades 410 and the front wall 311.

The ice jam prevention part 330 may be disposed above a portion at which the crushed ice cubes are discharged.

Figure 16:
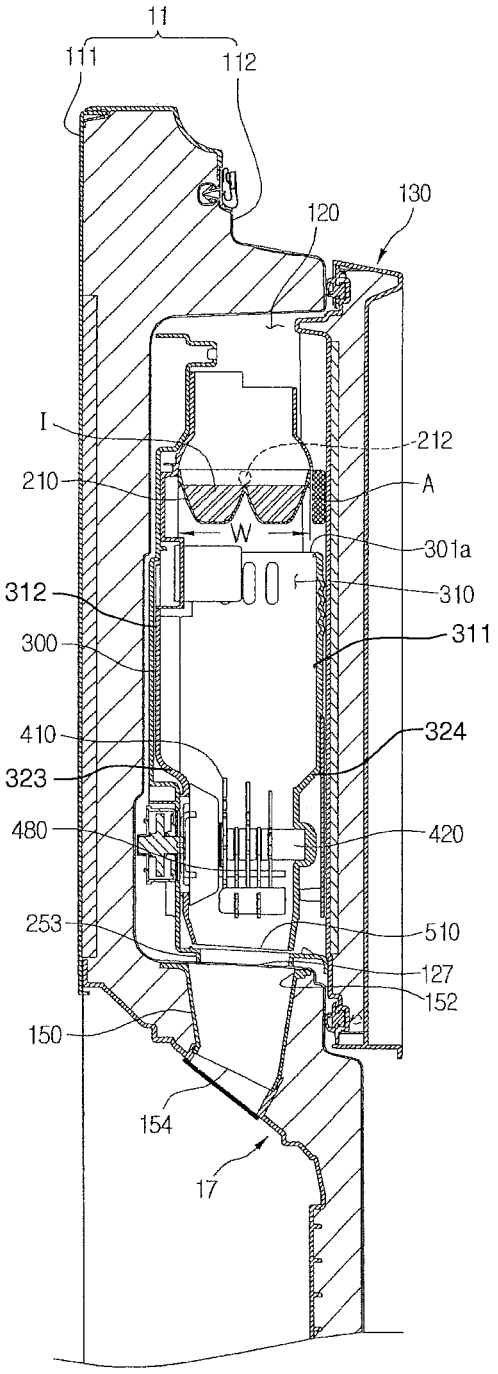
FIG. 16 is a vertical sectional view of the refrigerator compartment door of the first embodiment.
Figure 17:
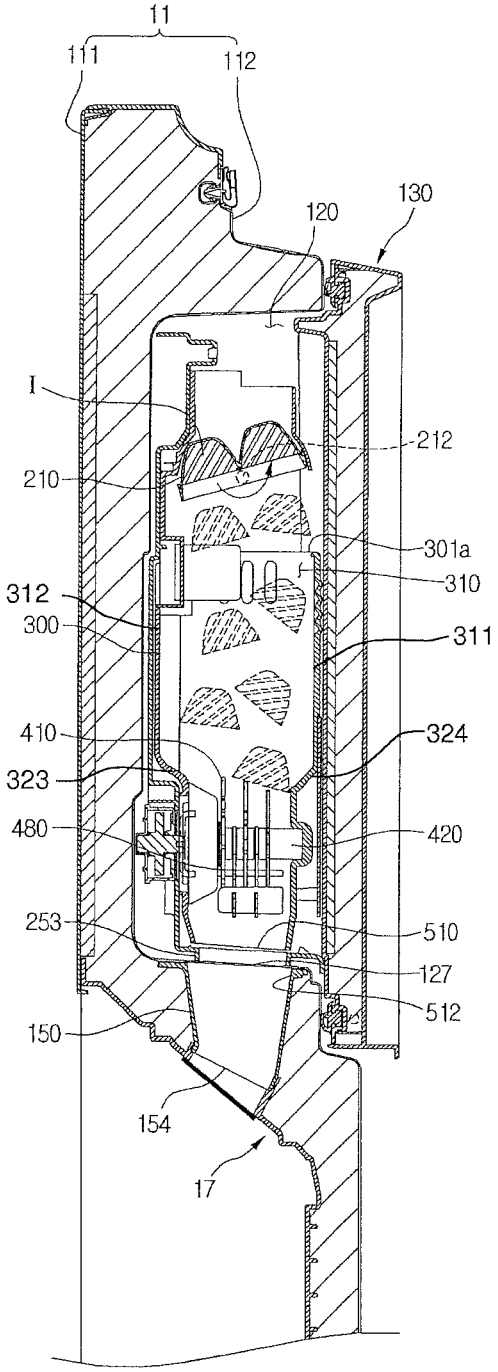
FIG. 17 is a view of a state in which an ice maker is rotated to separate ice from the ice maker of FIG. 16.

FIG. 16 is a vertical sectional view of the refrigerator compartment door of the first embodiment, and FIG. 17 is a view of a state in which an ice maker is rotated to separate ice from the ice maker of FIG. 16.

Referring to FIGS. 16 and 17, the ice bin 300 is substantially vertically disposed below the ice maker 210 in a state where the ice making assembly 200 is disposed within the ice compartment 120.

In detail, an inlet 301*a* of the opening 310 of the ice bin 300 is disposed at a position lower than that of the ice maker 210. Thus, when the ice compartment door 130 closes the ice compartment 120, the ice bin 300 is not disposed in a first region A between the ice compartment door 130 and the ice maker 210. That is, the ice bin 300 may be disposed in a second region except for a first region A between the ice compartment door 130 and the ice maker 210 in an entire region of the ice compartment 120.

This is done for a reason that the ice bin 300 does not need to dispose the ice bin 300 in the first region A because the ice maker 210 is tuned over by its rotation operation to separate ice cubes I from the ice maker 210 due to ice cubes' self-weight, thereby dropping into the ice bin 300. That is, since the ice cubes I separated from the ice maker 210 do not pass through the first region A, the ice bin need not be disposed in the first region A.

Thus, since the ice bin 300 is not disposed in the first region A, the ice compartment door 130 may be disposed further adjacent to the ice maker 210. As a result, a total thickness of the refrigerator compartment door 11 may be reduced. That is, the refrigerator compartment door 11 may be slim.

The rotation shaft 212 of the ice maker 210 crosses the rotation axis 420 disposed inside the ice bin 300. This is done because the ice compartment 120 increases in volume when the rotation shaft 212 of the ice maker 210 is disposed parallel to the rotation axis 420 disposed inside the ice bin 300.

The plurality of rotation blades 410 may be disposed spaced from each other in a direction parallel to the extending direction of the rotation axis 420. The plurality of rotation blades 410 may be disposed within a range of a front-rear width W of the ice maker 210.

Thus, when the ice maker 210 is rotated to separate the ice cubes I from the ice maker 210, a portion of the plurality of ice cubes separated from the ice maker 210 directly drops into at least one rotation blade of the plurality of rotation blades 410. That is, the ice cubes I separated from the ice maker 210 drop down by their self-weight, and at least one of the dropping ice cubes I directly contact at least one rotation blade 410.

At this time, a dropping direction of the ice cubes I separated from the ice maker 210 crosses the extending direction of the rotation axis 420. In another aspect, the dropping direction of the ice cubes I separated from the ice maker 210 is substantially parallel to a virtual surface defined when the plurality of rotation blades 410 is rotated.

A horizontal distance from the ice compartment door 130 to the rotation shaft 212 of the ice maker 210 is greater than the shortest horizontal distance from the ice compartment door 130 to the discharge opening 510.

Hereinafter, a movement process of the ice cubes generated at the ice making assembly will be described.

Figure 18:
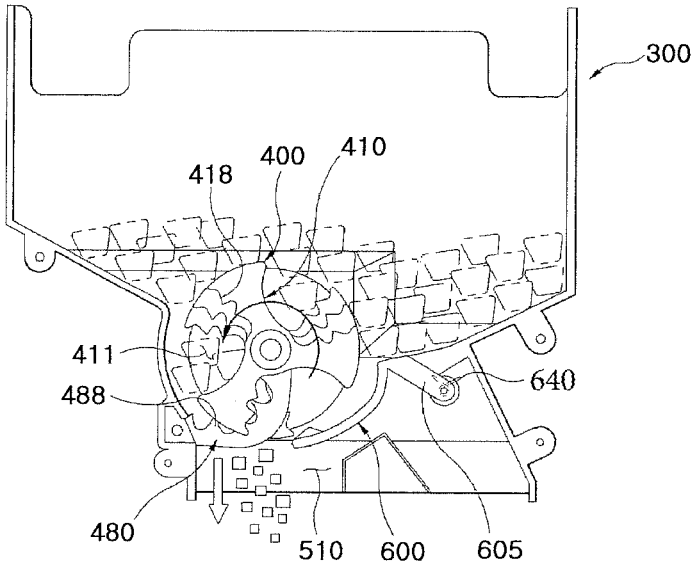
FIG. 18 is a front view of a state in which ice chips are discharged from the ice bin.
Figure 19:
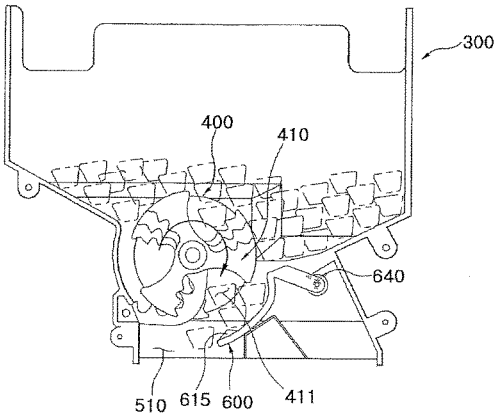
FIG. 19 is a front view of a state in which ice cubes are discharged from the ice bin.

FIG. 18 is a front view of a state in which ice chips are discharged from the ice bin, and FIG. 19 is a front view of a state in which ice cubes are discharged from the ice bin.

A process of discharging the generated ice cubes to the outside will described with reference to FIGS. 16 to 18.

To separate the ice cubes from the ice maker 210, when an operation signal is inputted into the driving source 220, the driving source 220 is operated. A power of the driving source 220 is transmitted to the ice maker 210 by the gear box 224 to rotate the ice maker 210 on a whole.

In this embodiment, the ice cubes are separated by the twisting operation of the ice maker 210. When the twisting operation of the ice maker 210 is performed, one end and the other end of the ice maker 210 are twisted by their relative motion. Thus, the ice cubes are separated from the ice maker 210. Since a principle of the twisting operation of the ice maker 210 is well-known, detailed descriptions will be omitted.

The ice cubes separated from the ice maker 210 drop into the ice bin 300 through the inlet 301*a* of the opening 310 of the ice bin 300.

As described above, a portion of the ice cubes separated from the ice maker 210 may drop onto the plurality of rotation blades 410, another portion of the ice cubes may drop onto the first inclined guide surface 321, and further another portion of the ice cubes may drop onto the second inclined guide surface 322.

To dispense the crushed ice chips, when the ice discharge member 400 is rotated in the first direction (in a counterclockwise direction when viewed in FIG. 18), the crush part 418 of the plurality of rotation blades 410 is getting close to the crush part 488 of the fixed blade 480.

Thus, the ice cubes disposed in the space 411 of the plurality of rotation blades 410 are disposed on the fixed blade 480 by the rotation of the rotation blades 410. In this embodiment, the ice cubes disposed in the space 411 may be the ice cubes directly dropping onto the plurality of rotation blades 410 or the ice cubes sliding along the first inclined guide surface 321.

In this state, when the plurality of rotation blades 410 is continuously rotated in the first direction, the ice cubes jammed between the crush part 418 of the rotation blade 410 and the crush part 488 of the fixed blade 480 are crushed. The crushed ice chips drop in a direction of the discharge opening 510 and are discharged to the outside.

In a process of discharging the ice chips, since the opening/closing member 600 is maintained in the close state, it may prevent the ice cubes disposed on the second inclined guide surface 322 from being discharged.

In a process of discharging the ice cubes, when the ice discharge member 400 is rotated in the second direction (in a clockwise direction when viewed in FIG. 18), the ice cubes disposed in the space 411 of the plurality of rotation blades 410 are moved in a direction of the opening/closing member 600 by the rotation of the rotation blades 410.

The ice cubes disposed in the space 411 of the plurality of rotation blades 410 may be the ice cubes directly dropping onto the plurality of rotation blades 410 or the ice cubes sliding along the second inclined guide surface 322.

When the plurality of rotation blades 410 is continuously rotated in the second direction, the extension part 413 of the respective rotation blades 410 pushes the ice cubes disposed on the opening/closing member 600. As a result, the compression forces of the rotation blades 410 are applied to the opening/closing member 600 by the ice cubes.

Thus, the opening/closing member 600 is downwardly rotated (in a counterclockwise direction when viewed in FIG. 19) by the compression force of the ice cubes and the rotation blades 410. As a result, a space is defined between an end of the extension part 413 of the respective rotation blades 410 and an end of the opening/closing member 600. Then, the ice cubes are moved into the space, and finally, the ice cubes are discharged to the outside.

When the rotation of the ice discharge member 400 is stopped, since the pressure applied to the opening/closing member 600 is removed, the opening/closing member 600 returns to its initial position by the elastic force of the elastic member 640.

A summary of the movement of the ice cubes within the ice bin 300 is as follows. The ice cubes dropping onto the plurality of rotation blades 410 are downwardly moved when the plurality of rotation blades 410 is rotated.

The ice cubes dropping onto the first inclined guide surface 321 are moved into the space 411 by their self-weight when the plurality of rotation blades 410 is rotated in the first direction. When the plurality of rotation blades 410 is rotated, the ice cubes within the space 411 are downwardly moved.

Also, the ice cubes dropping onto the second inclined guide surface 322 are moved into the space 411 by their self-weight when the plurality of rotation blades 410 is rotated in the second direction. When the plurality of rotation blades 410 is rotated, the ice cubes within the space 411 are downwardly moved.

Substantially, the ice cubes disposed on the respective inclined surfaces 321 and 322 are not moved in a state where the operation of the plurality of rotation blades 410 is stopped.

As a result, according to this embodiment, the stored ice cubes may be discharged to the outside by the rotation operation of the plurality of rotation blades 410 without requiring an additional transfer unit within the ice bin 300.

Also, the ice cubes within the ice bin 300 are moved only from upper side to lower side, i.e., the inlet 301*a* of the ice bin 300 to the discharge opening 510 except for the mutual movement between the ice cubes.

When the inlet 301*a* of the ice bin 300 and the discharge opening 510 of the ice bin 300, the ice opening 253 of the first support part 252, the opening of the door liner 112, an inlet 152 and outlet 154 of the ice duct overlap each other, an overlapping common region is formed. Thus, the movement path of the ice cubes may be minimized.

A technical significance of this embodiment according to the above-described constitution will be described below.

As described above, since the ice cubes within the ice bin are moved from the upper side to the lower side and moved and drop by the plurality of rotation blades, the ice bin may be reduced in thickness.

In this embodiment, the thickness of the ice bin represents a thickness of the ice bin in the extending direction of the rotation axis.

The refrigerator compartment door may be reduced in thickness by the decrease of the thickness of the ice bin and the position of the ice bin within the ice compartment according to the separation method of the ice cubes from the ice maker.

When the refrigerator compartment door is reduce in thickness, a basket for additionally receiving the food may be disposed in the refrigerator compai went door.

In addition, when the refrigerator compartment door is reduce in thickness, since a portion (that is inserted into the refrigerator compartment) of the refrigerator compartment door is reduced in volume, receivable capacity of the refrigerator compartment may increase.

Figure 20:
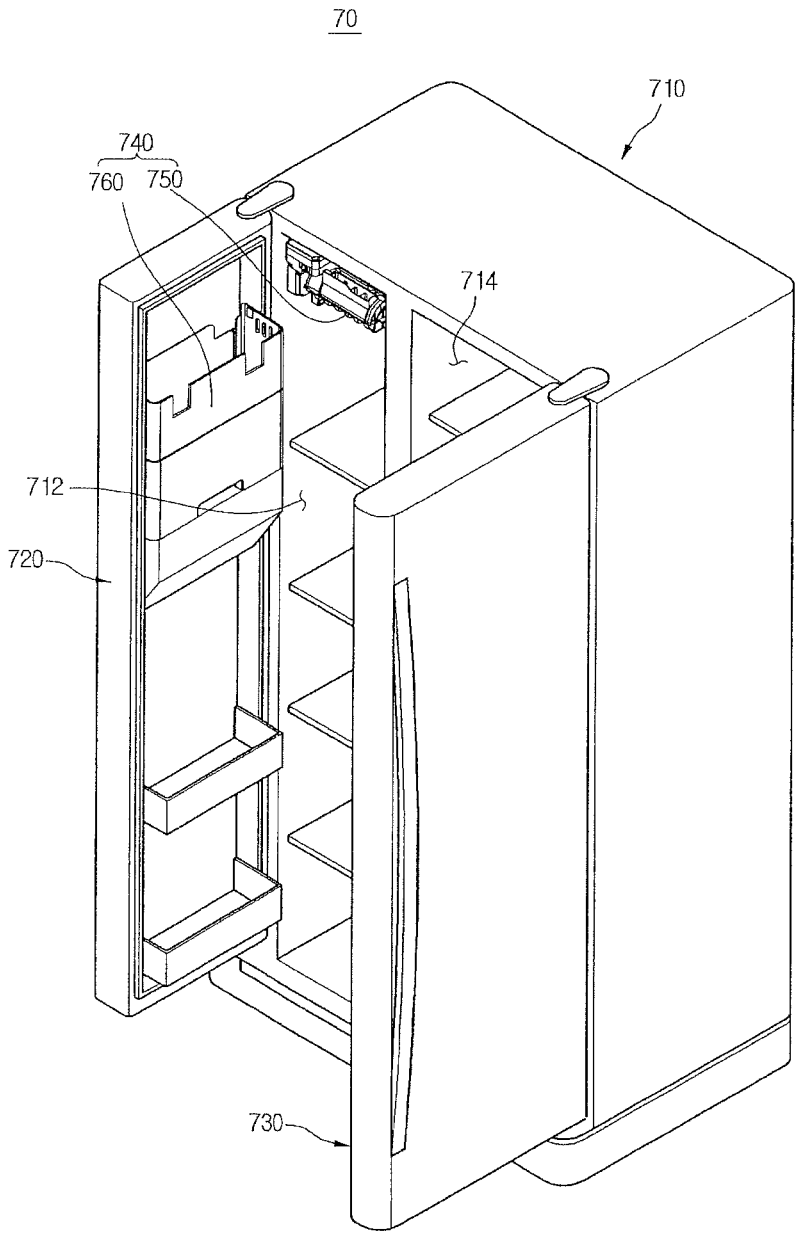
FIG. 20 is a perspective view of a refrigerator according to a second embodiment.

FIG. 20 is a perspective view of a refrigerator according to a second embodiment.

This embodiment is equal to the first embodiment except for a kind of refrigerator and a position of an ice making assembly. Thus, only specific portions of this embodiment will now be described.

Referring to FIG. 20, a refrigerator 70 of this embodiment may be a side-by-side type refrigerator in which a refrigerator compartment 712 and a freezer compartment 714 are disposed at left and right sides, respectively.

The freezer compartment 712 is opened and closed by a freezer compartment door 720, and the refrigerator compartment 714 is opened and closed by a refrigerator compartment door 730.

The refrigerator 70 includes an ice making assembly 740 for generating ice cubes.

The ice making assembly 740 includes an ice maker 750 for generating the ice cubes and an ice bin 760 for storing the ice cubes separated from the ice maker 750.

In this embodiment, the ice making assembly has the same structure as that of the first embodiment except positions of the ice maker and the ice bin.

The ice maker 750 is disposed in the freezer compartment 712, and the ice bin 760 is separably disposed in the freezer compartment door 720. When the freezer compartment door 720 closes the freezer compartment 712, the ice bin 760 is disposed below the ice maker 750.

According to this embodiment, the freezer compartment door may be reduced in thickness due to the improved structure of the ice bin.

Figure 21:
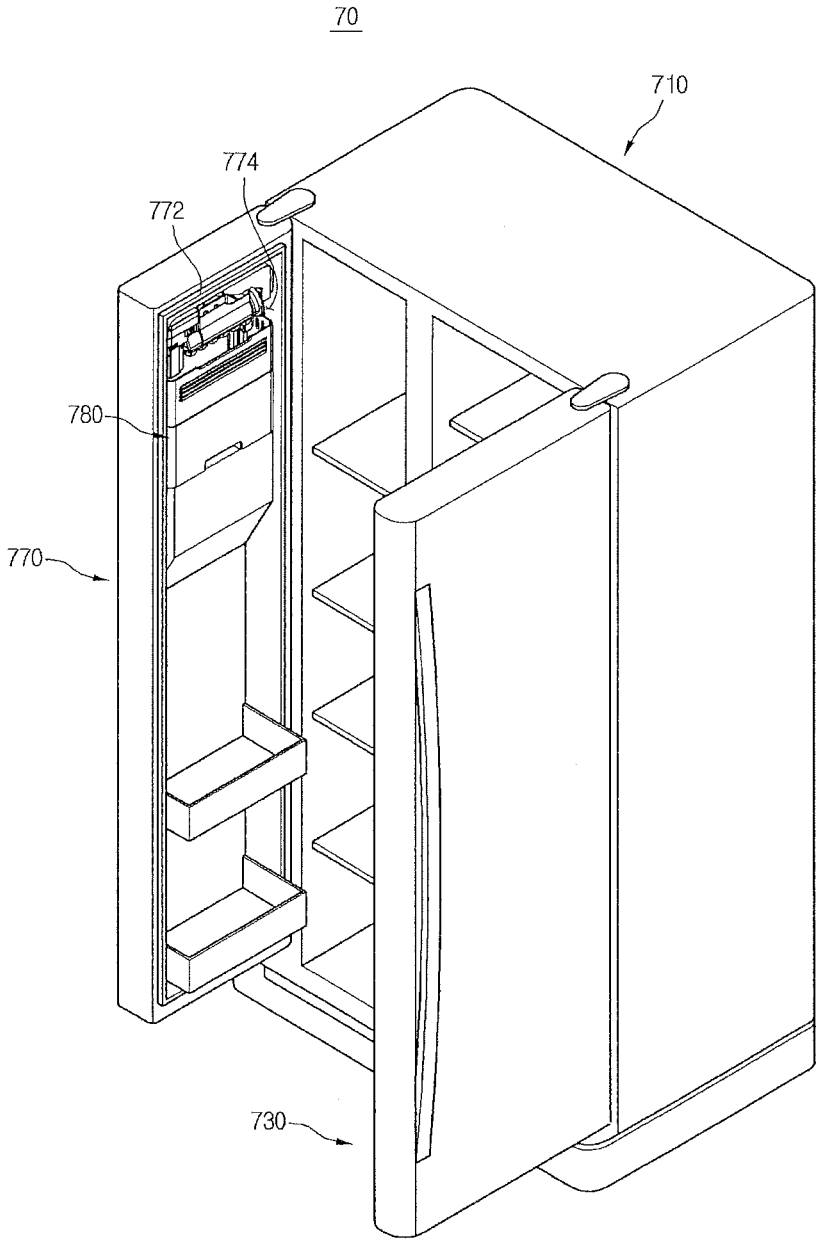
FIG. 21 is a perspective view of a refrigerator according to a third embodiment.

FIG. 21 is a perspective view of a refrigerator according to a third embodiment.

This embodiment is equal to the second embodiment except for a position of an ice making assembly. Thus, only specific portions of this embodiment will now be described.

Referring to FIG. 21, a freezer compartment door 770 of this embodiment includes a door liner 772 defining an ice compartment 774. The ice compartment 774 includes an ice making assembly 780. In this embodiment, the ice making assembly 780 has the same structure as that of the first embodiment. According to this embodiment, the freezer compartment door may be reduced in thickness due to the operation of the ice maker and the improved structure of the ice bin, which are described in the first embodiment.

Figure 22:
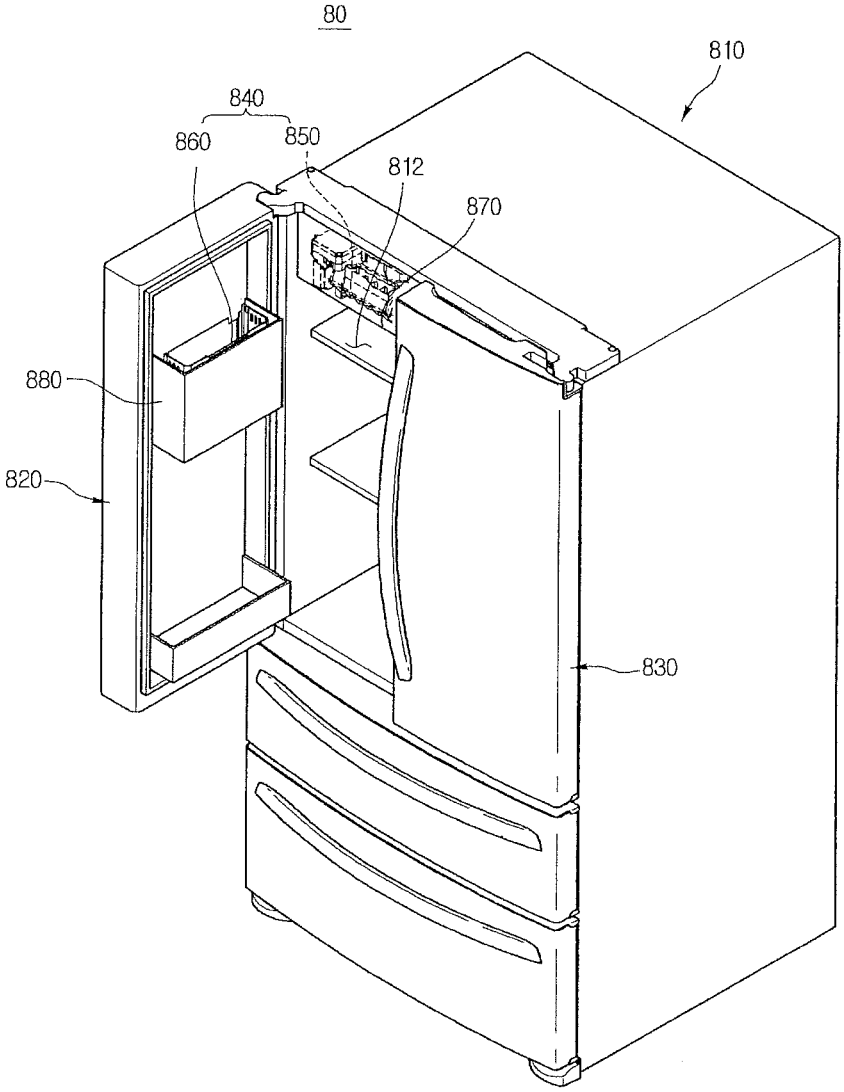
FIG. 22 is a perspective view of a refrigerator according to a fourth embodiment.

FIG. 22 is a perspective view of a refrigerator according to a fourth embodiment.

This embodiment is equal to the first embodiment except for a position of an ice making assembly. Thus, only specific portions of this embodiment will now be described.

Referring to FIG. 22, a bottom freeze type refrigerator as an example will be described as an example. An ice bin 860 is disposed in one of refrigerator compartment doors 820 and 830. Other components (e.g., an ice maker 850) of an ice making assembly except the ice bin 860 are disposed in freezer compartment 812.

A first insulation case 870 for insulating a space in which ice cubes are generated from the refrigerator compartment 812 is disposed in the refrigerator compartment 812. The ice maker 850 is disposed within the first insulation case 870. A bottom surface of the first insulation case 870 may be opened, and thus, the ice cubes generated in the ice maker 850 may drop down.

Also, a second insulation case 880 for receiving the ice bin 860 is disposed in the refrigerator compartment door. A top surface of the second insulation case 880 may be opened to receive the ice cubes. When the refrigerator compartment door closes the refrigerator compartment, the second insulation case is disposed below the first insulation case.

At this time, a sealing part (not shown) may be disposed on one of the first and second insulation cases 870 and 880 to seal a space between a bottom surface of the first insulation case 870 and a top surface of the second insulation case 880.

According to this embodiment, the refrigerator door may be reduced in thickness due to the improved structure of the ice bin.

According to the proposed embodiments, since the ice cubes within the ice bin are moved from the upper side to the lower side and moved and drop by the plurality of rotation blades, the ice bin can be reduced in thickness.

Also, the refrigerator compartment door can be reduced in thickness by the decrease of the thickness of the ice bin and the position of the ice bin within the ice compartment according to the separation method of the ice cubes from the ice maker.

When the refrigerator door becomes slim, a basket for additionally receiving the food can be disposed in the refrigerator door.

Also, when the refrigerator door becomes slim, since a portion (that is inserted into the storage compartment) of the refrigerator door is reduced in volume, the receivable capacity of the storage compartment can increase.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet that defines a storage compartment;

a refrigerator door that is configured to open and close the storage compartment;

an ice maker that is configured to generate ice and that defines a space;

an ice bin that is mounted to the refrigerator door, that is located below the ice maker, that is configured to receive ice generated by the ice maker, and that defines a discharge hole at a bottom of the ice bin;

a motor assembly that is located in the refrigerator door and that includes a connection member;

an ice discharge member that is located in the ice bin, that is configured to selectively discharge ice in the ice bin, and that comprises:

a connection plate that is selectively connected to the connection member;

a protrusion that is located on the connection plate and that is configured to connect to the connection member;

a support plate;

a rotation axis that passes through the ice bin, the connection plate, and the support plate;

an elastic member that is located between the support plate and the connection plate and that is configured to elastically support the connection plate;

a plurality of rotation blades that are fixed to the rotation axis and that are spaced from each other in a first direction that is parallel to the rotation axis; and a plurality of fixed blades alternately located between the plurality of rotation blades, wherein each of the plurality of rotation blades comprises:

a central portion that defines a trough-hole that is configured to receive the rotation axis; and a plurality of extension parts that radially extend from the central portion and that each comprise:

a first side surface that includes one or more crush parts that protrude in a first direction; and a second side surface that is located opposite the first side surface and that includes a hook part (i) that is located at a radial end of the extension part and (ii) that protrudes in a second direction that is opposite the first direction, and wherein the first side surface and the second side surface of adjacent extension parts face each other, curve in opposite directions, and define a holding space to receive ice.

2. The refrigerator of claim 1, wherein the support plate includes an inclined surface that is configured to move ice dropped from the ice maker towards the plurality of rotation blades.

3. The refrigerator of claim 1, wherein:

the ice bin comprises:

a front wall;

a rear wall;

side walls that connect the front wall with the rear wall; and an ice jam prevention part is located between a rotation blade at an end of the plurality of rotation blades and a rear surface of the front wall, the ice bin defines an opening at an upper side of the ice bin.

4. The refrigerator of claim 3, wherein the ice bin comprises:

a first inclined guide surface that slopes down from a first wall of the side walls towards a central portion of the ice bin;

a second inclined guide surface that slopes down from a second wall of the side walls towards the central portion of the ice bin; and a discharge guide wall that has a curvature that corresponds to a curvature of a rotational track of a rotation blade.

5. The refrigerator of claim 4, wherein an end of the first inclined guide surface is located above the rotation axis.

6. The refrigerator of claim 1, wherein the ice bin comprises an insertion member that passes through the rotation axis.

7. The refrigerator of claim 1, wherein each of the plurality of rotation blades defines a through-hole through which the rotation axis passes.

8. The refrigerator of claim 7, wherein each through-hole has a non-circular shape.

9. The refrigerator of claim 1, wherein a width of each of the plurality of extension parts gradually increases towards an end of the extension part.

10. The refrigerator of claim 1, wherein the elastic member is coil shaped and is coupled to the rotation axis.

* * * * *